US006559770B1

(12) United States Patent
Zoerb

(10) Patent No.: US 6,559,770 B1
(45) Date of Patent: May 6, 2003

(54) EYELASH ACTIVATED DROWSY ALARM

(76) Inventor: Edward George Zoerb, 3170 Sandy Hook Dr., Roseville, MN (US) 55113

( * ) Notice: Subject to any disclaimer, the term of this patent is extended or adjusted under 35 U.S.C. 154(b) by 4 days.

(21) Appl. No.: 09/683,923

(22) Filed: Mar. 2, 2002

(51) Int. Cl.[7] ..... G08B 21/00
(52) U.S. Cl. ..... 340/575; 340/576
(58) Field of Search ..... 340/573.1, 575, 340/576, 573.7

(56) References Cited

U.S. PATENT DOCUMENTS 2,726,380 A * 12/1955 Campisi ..... 340/575
4,144,531 A * 3/1979 Anbergen ..... 340/575
4,145,122 A * 3/1979 Rinard et al.
4,875,030 A * 10/1989 Chiu ..... 340/575
4,953,111 A * 8/1990 Yamamoto et al. ..... 340/575
4,967,186 A * 10/1990 Ludmirsky et al. ..... 340/575
5,402,109 A * 3/1995 Mannik ..... 340/575
5,682,144 A * 10/1997 Mannik ..... 340/575
5,745,038 A * 4/1998 Vance ..... 340/575

* cited by examiner

*Primary Examiner*—Daniel J. Wu

(57) ABSTRACT

A safety apparatus utilizing an eyeglass mounted light beam emitter and detector which will sound an alarm when a drowsy driver's eye closes and his eyelashes interrupt a focused light beam. This device will prevent drivers from falling asleep and thereby prevent accidents. Usage of the device by pilots, factory workers, guards, and watchmen will improve their work performance and safety.

2 Claims, 6 Drawing Sheets

EYELASH ACTIVATED DROWSY ALARM

CROSS REFERENCE TO RELATED APPLICATTIONS

Key patents purporting solutions to the drowsy driver problem by the use of light beams reflecting from the eye or eyelid or the interception of a beam close to the eye by the eyelid or eyelash are: U.S. Pat. No. 4,144,531 Mar. 19,1979, Anbergen: U.S. Pat. No. 4,145,122 Mar. 20, 1979, Rinard et al; U.S. Pat. No. 4,875,030 Oct. 17, 1989, Chiu; U.S. Pat. No. 4,953,111 Aug. 28, 1990, Yamamoto et al; U.S. Pat. No. 4,967,186 Oct. 30, 1990, Ludmirsky et al; U.S. Pat. No. 5,402,109 Mar. 28, 1995, Mannik; U.S. Pat. No. 5,682,144 Oct. 28, 1997, Mannik; U.S. Pat. No. 5,745,038 Apr. 28, 1998, Vance; U.S. Pat. No. 5,689,241 Nov. 1997 Clarke, Sr. et al.

BACKGROUND OF THE INVENTION

The above patent approaches may work technically, but visible light is annoying and infrared or ultraviolet light impinging upon the eye is not desirable to many users because of perceived eye damage which may accumulate from long exposure. Successful commercialization of a device requires that the buyer feel safe in its use.

Some of the referenced approaches focus beams directly into the eye, and others have beams in close proximity such that scattered or misdirected light may enter the eye. Most beams are of low power level and would not be expected to damage the eye, but this would be very hard to prove. The present invention alleviates this problem by utilizing the eyelash, which is a safe distance from the eye, and by carefully focusing the light beam so that it does not enter the eye. Only the eyelash can scatter the light beam, and in that instance the eye is closed and the alarm activated. Companies are more comfortable in commercializing a product which has no chance of attracting liability lawsuits.

Much camera based sleep prevention work is ongoing, an example of which is U.S. Pat. No. 5,689,241 Nov. 1997 Clarke, Sr., et al., and these devices have the advantage of multi-user use, but have the difficulty of rapid complex image acquisition and processing which will likely require a high price. Cameras may be passive during the day but may require eye illumination at night. In addition, there may be a signal attenuation if the driver is wearing sun glasses. Automobile camera installations may be expected in a few years on some expensive vehicles, but it will be slow and costly in spreading to all new vehicles. New car installations will not affect the millions of vehicles already on the road. In addition, cameras fixed to a vehicle are of a single use, whereas, this invention may be used by watchmen and others who must move about on foot from place to place.

Falling asleep in the wrong situation can be a life or death matter, and many injuries and deaths now attributable to drunken driving and other causes may be due to falling asleep at the wheel. Drowsy driving has been a key focus for a number of inventions over the past 25 years. Among these are rumble strips, ear mounted head nodding sensors, steering wheel motion sensors, eyelid and eyelash sensors, eye muscle sensors, brain wave sensors, and face scanning cameras. Each of these has particular advantages and disadvantages. The eyelash sensor, invented some twenty years ago, is one of the better choices for commercialization because it is moderate in price and complexity, is expected to be reliable in operation, and is predictive of sleep.

This present invention, referred to herein as "Drowsy alarm glasses", is an improvement of the original run-out U.S. Pat. No. 4,144,531, March of 1979, by Henricus Anbergen. The improvements consist of the following: the use of a focused beam for accurate eyelash detection, the elimination of the light attenuation and scattering from the mirrors and reflux cell, the addition of a filter to minimize ambient light effects, the addition of a shield to block direct sunlight, the simplification of the optical path to improve peripheral vision, the ability to fold, and the ability to be removed from the users eyeglasses when not needed.

SUMMARY OF INVENTION

A safety apparatus which utilizes an eyeglass mounted light emitter and detector and which will sound an alarm when a drowsy driver's eye closes and his eyelashes interrupt a light beam. This device will prevent drivers from falling asleep and thereby prevent accidents.

This device is an improvement of run-out U.S. Pat. No. 4,144,531 May 1979 by Henricus Anbergen because it provides a method of focusing the light beam to a small diameter at the center of the eyelash where the eyelash is more easily and reliably sensed. In addition, the focused beam does not have stray light rays which may enter the eye. Usage of the device by pilots, factory workers, guards, and watchmen will improve their work performance and safety.

DETAILED DESCRIPTION

Figure 1:
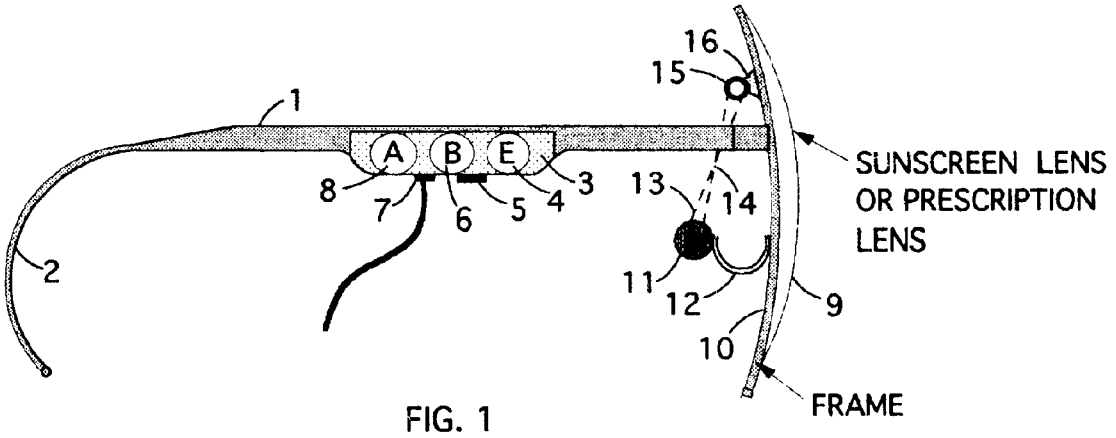
FIG. 1 is a side view of the drowsy alarm glasses.

Referring to FIG. 1., the eyeglass frame's ear-piece 1 includes a back of the ear hook 2 to hold the glasses in a stable position, and the ear-piece also supports the electronics module 3 within which an miniaturized electronics assembly 4 is activated by an on/off switch 5 supplied by a rechargeable battery 6. An electrical plug-in cord 7 from a cigarette lighter socket, or other source, supplies power when recharging is required and during times when the battery is depleted. Alarm of drowsiness is provided to the driver by an audible sound from a speaker 8. A vibrator could be provided for the deaf, for those who enjoy loud radio music, or are loudly conversing.

The electronics module 3 is located toward the center of the ear-piece 1 and therefore not in the way of peripheral vision as was the enclosure for the wave emitter, reflex cell and photo-detector in the Anbergen patent. The device is independent of the type of lens 9 used in the glasses.

The lens frame 10 supports an infrared emitter module assembly 11 by means of a bendable support attachment member 12 which provides both fore and aft linear and also angular adjustment of the beam 13. The beam is focused to a point 14 which is approximately at the center of the eyelash when the eye is closed. If not interrupted by the eyelash, the beam continues on to impinge on the detector module assembly 15 supported by attachment member 16 from the eyeglass frame 10.

Figure 2:
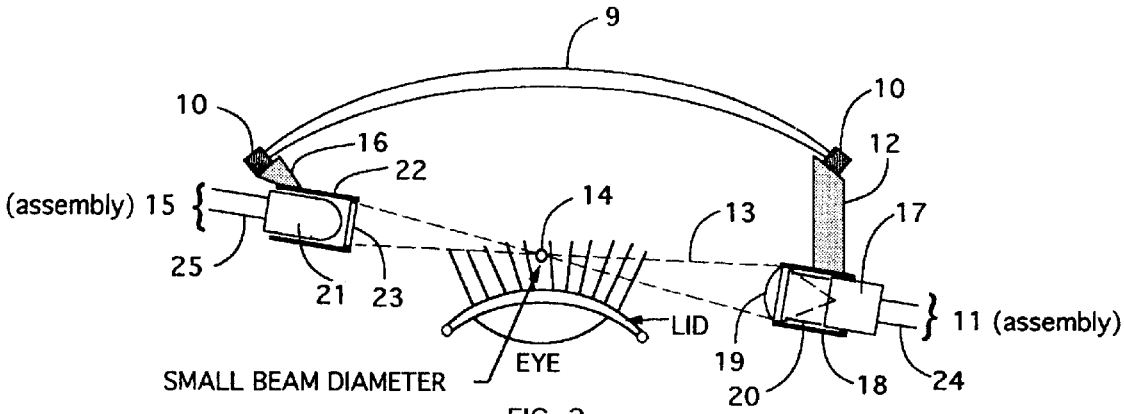
FIG. 2 is a top view of the drowsy alarm glasses.

FIG. 2. is a top view showing the position of the light beam being intersected by the eyelash when the right eye is closed. The angled position of the beam allows the detector module assembly 15 to be mounted close to the glasses' frame at the nose for easier fit. Emitter module assembly 11 consists of a light-beam source such as an infrared light emitting diode 17 mounted in an enclosure 18 along with a lens 19 and an anti-reflecting light absorbing member 20. The lens is placed such as to produce a focused beam at point 14 which is close to the centerline of the eye and the most dense part of the eyelash. The enclosure 18 is supported by a bendable attachment member 12 which is fixed to the eyeglass frame 10 which is in-turn supported by the standard nose pads on the eyeglasses. The bendable member 12 may be bent to change its circular shape and thereby to adjust the fore and aft position of emitter assembly 11, and it may be twisted to change the angular adjustment of the light beam 13. Within enclosure 18 is a nonreflecting (rough and blackened inner surface) cylinder 20 which absorbs light and thereby prevents the reflection of non-focusable light rays from impinging on lens 19 and subsequently scattering into the eye.

Light Emitting Diodes ( LED's ) normally emit a very broad light beam. Lenses on LED's are common to reduce the beam spread in an attempt to produce a collimated beam, but their usage to produce a near-in focus point is not available from the information provided in manufacturers catalogues. Experiments with catalogue LED's and short focus lenses did not produce a sharp image because of the light scattering effects of the encapsulation material. To produce a sharp focus with the lens, it was necessary to remove most of the encapsulation material beyond the diode junction and to optically polish the encapsulation material surface just adjacent to the junction. LED's without back reflectors were found to produce sharper beams.

The beam 13 produced by the emitter 17 and focused by the lens 19 expands beyond point 14 and passes through optical filter 23, which blocks unwanted shorter and longer wavelengths (particularly sunlight), then impinges on a phototransistor or other light sensing device 21 thereby producing an electric current or modifying an applied current. Fully exposed and processed camera color film was used as a suitable optical filter 23 in test experiments; however, a filter whose transparency has a rather sharp peak in the 1 micron range would be desirable.

The detector module assembly 15 consists of the housing 22 which blocks ambient light, such as sunlight, the light sensing detector 21, such as a phototransistor, and the filter 23, and is mounted to the glasses frame 10 by member 16. Member 16 is bendable and may be twisted to align detector module 15 with emitter module 11. Emitter leads 24 and detector leads 25 are attached to or integrated within the frame 10 and ear-piece 1. The leads should loop around the glasses' hinge point or have contacts at the hinge point so that the glasses will fold.

Figure 3:
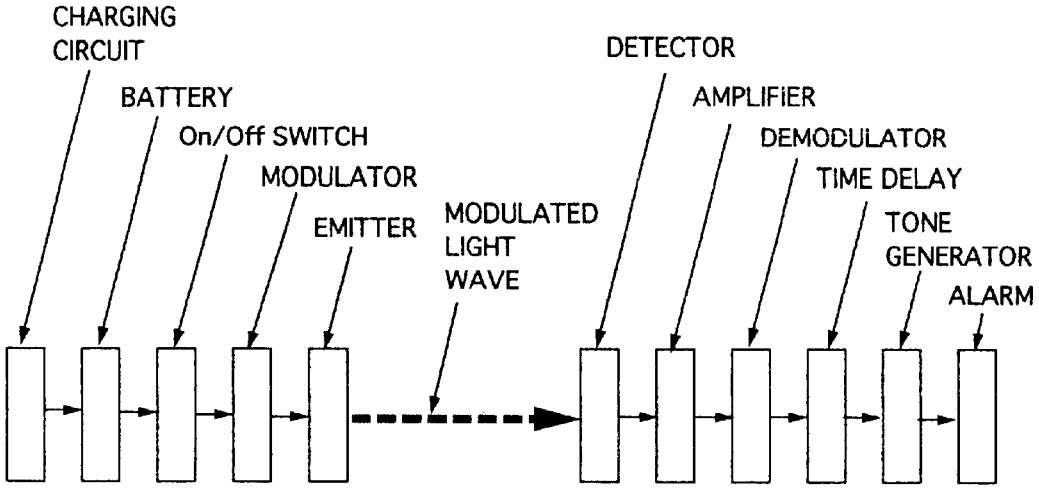
FIG. 3 is a functional diagram of the associated electronics.

It is necessary to modulate the light beam in order to separate it from the variation in ambient light levels ranging from bright sunlight to night light levels. There are many ways, both analogue and digital, to accomplish the modulation and subsequent signal processing. It should be noted that the Anbergen patent used a counting scheme. FIG. 3. shows the main electronic functions which are: the charging circuitry, rechargeable battery 6, On/Off switch 5, modulator, emitter, detector, amplifier, demodulator, time delay, tone generator, and alarm 8.

Eyelash interruption of the light beam must cause alarm; therefor, inversion of the signal and the setting of a signal threshold at which the alarm is to occur are also necessary signal processing functions. Some or all of these functions could be non-miniaturized and mounted in a remote separate enclosure and be placed in a pocket, hung on a chain, or attached to clothing.

Figure 4:
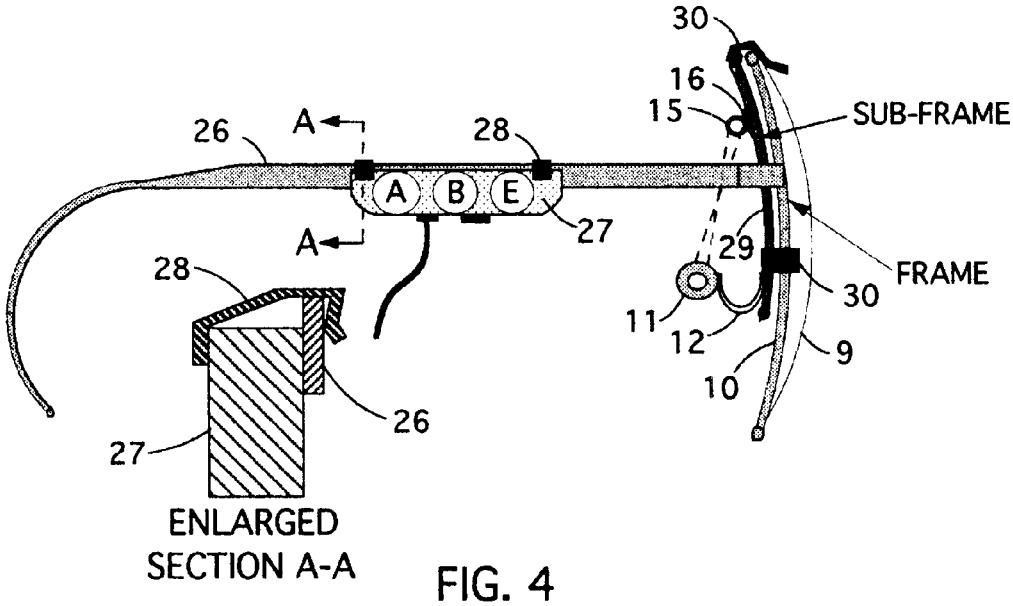
FIG. 4 is a side view of the insert option of the drowsy alarm glasses.

Another implementation of this patent, noted herein as the "Insert Option", is shown in FIG. 4. In this option, an electronics module 27 (similar to 3) is fitted with clips 28 such that it may be temporarily fastened to the ear-piece 26 of ordinary glasses having ear hooks and being of either metal or plastic construction. Similarly, the emitter and detector modules 11 & 15 would also be fastened by their attachment supports 12 and 16 to a sub-frame 29 which would in-turn use clips 30 to fasten it onto the lenses frame 10. This sub-frame 29 will keep the optical elements in alignment even when not clipped onto the glasses.

These modules could be readily removed during times when the alarm was not needed. This implementation has a cost advantage because the owner already owns his glasses, and also because the modules may be transferred should a new pair of glasses be purchased. The modules could all be clipped to a single larger sub-frame (not shown), but this sub-frame would have to be hinged on the same axis as the glasses hinge if the assembly is to fold.

Figure 5:
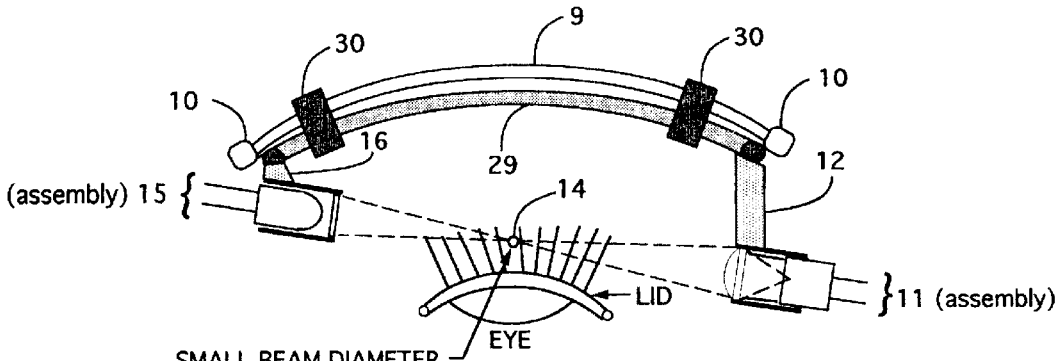
FIG. 5 is a top view of the insert option of the drowsy alarm glasses.

FIG. 5 shows the top view with the sub-frame 29 in place. Emitter assembly 11 and detector assembly 15 are supported by attachment members 12 and 16 respectively to the insert sub-frame 29 which is fastened to the glasses frame 10 by clips 30.

Figure 6:
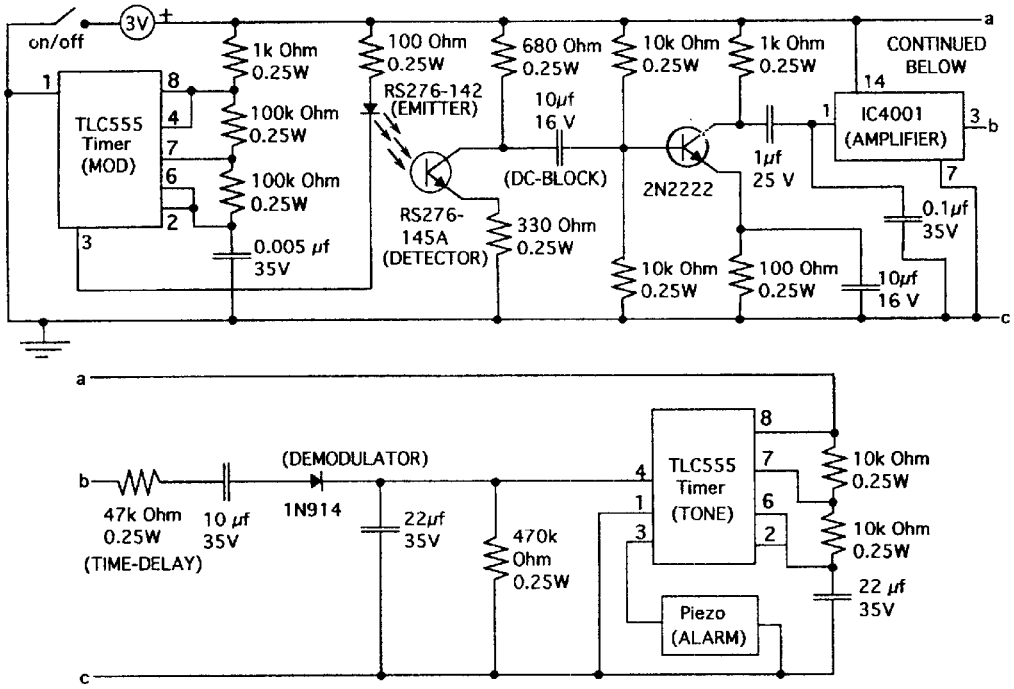
FIG. 6 is a schematic circuit of the test electronics.

Preliminary device testing was conducted on a test model of the glasses using RadioShack (trade mark) components (RS276-142 emitter, RS276-145A phototransistor), and a 4mm diameter lens with a 4mm focal length. The device was operated in the infrared at 915 nanometers and square wave modulated at 3KHz. The glasses were similar to that shown in FIG. 1, but used external analogue electronics of discrete and integrated circuit components. FIG. 6 is the schematic diagram for the test model electronics.

The device was tested on six subjects in the absence of sunlight. Testing for false alarms from eye blinks gave 9 false alarms from 430 blinks for a false alarm rate of 2% with a delay setting of one second. Greater delay settings produce smaller false alarm rates. Production devices would be expected to have even better performance and to be miniaturized. Failure to alarm was tested 60 times with a one second delay and gave no failures.

What is claimed is:

1. An eyelash activated safety apparatus to alarm the wearer of becoming drowsy comprising:

a. A supporting means for holding the apparatus in a fixed position on the face of the wearer through the use of apparatus attachments, ear hooks and nose supports;

b. An emitter means, to convert electrical energy to light energy at a particular wavelength or band of wavelengths, and which has low light scattering properties so that the light produced and falling on a lens may be sharply focused;

c. A signal processing means to modulate said electrical energy for said emitter so that the modulated light signal produced by the emitter may be detected and electrically processed to separate it from ambient light effects and to provide amplification, time delay, and alarm activation functions when a focused emitter beam is interrupted by eyelash closure or near closure;

d. A lens means positioned in the emitter module to focus emitted light energy to a point near the center of the eyelash where it is blocked by the eyelash when the eye is closed or close to being closed;

e. A light absorbing means to prevent emitter light from reflecting off of the emitter enclosure wall and passing through the lens on a non-focusable path and thereby entering the eye;

f. A detector means for sensing emitter light energy and converting it to an electrical signal and oriented such that the emitter light energy impinges on the detector means when the eye is open;

g. An optical filter means mounted in front of said detector to block light energy of shorter and longer wavelengths from that of said emitter, and thereby to eliminate part of unwanted sunlight and other ambient light;

h. A detector housing means to block unwanted light, which would tend to saturate and overload the detector and amplifier components and thereby reduce the sensed signal;

i. An adjustment means to provide linear and angular alignment for the emitted light beam such that the beam will intersect the eyelashes when closed and be in alignment with the detector; and j. An adjustment means for the detector, to provide a separate angular adjustment means to align the detector with the emitted light beam.

2. An apparatus according to claim 1, further comprising:

An insert module means whereby the emitting, detecting, signal processing, alarm and other necessary functions are included in a module or set of modules which may be easily attached and easily removed from a common pair of glasses of either metal or plastic construction.

* * * * *